US006424599B1

(12) United States Patent
Ditzig

(10) Patent No.: US 6,424,599 B1
(45) Date of Patent: Jul. 23, 2002

(54) BOTTLE CAP REMINDER DEVICE AND METHOD

(76) Inventor: Albert F. Ditzig, 1135 Mayfield La., Hoffman Estates, IL (US) 60195

( * ) Notice: Subject to any disclaimer, the term of this patent is extended or adjusted under 35 U.S.C. 154(b) by 0 days.

(21) Appl. No.: 09/457,270

(22) Filed: Dec. 8, 1999

Related U.S. Application Data

(63) Continuation-in-part of application No. 09/099,095, filed on Jun. 18, 1998.

(51) Int. Cl.[7] ..... G04B 47/00
(52) U.S. Cl. ..... 368/10
(58) Field of Search ..... 368/10, 223, 281, 368/282

(56) References Cited

U.S. PATENT DOCUMENTS

| | | | |
|---|---|---|---|
| 4,223,801 | A | 9/1980 | Carlson |
| 4,367,955 | A | 1/1983 | Ballew |
| 4,382,688 | A | 5/1983 | Machamer |
| 4,419,016 | A | 12/1983 | Zoltan |
| 4,528,933 | A | 7/1985 | Allen |
| 4,562,933 | A | 1/1986 | Dennis |
| 4,660,991 | A | 4/1987 | Simon |
| 4,731,765 | A | 3/1988 | Cole et al. |
| 4,768,176 | A | 8/1988 | Kehr et al. |
| 4,847,597 | A | 7/1989 | Dobosi et al. |
| 4,939,705 | A | 7/1990 | Hamilton et al. |
| 5,170,380 | A | 12/1992 | Howard et al. |
| 5,233,571 | A | 8/1993 | Wirtschafter |
| 5,313,439 | A | 5/1994 | Albeck |
| 5,577,335 | A | 11/1996 | Tucker |
| 5,662,224 | A | 9/1997 | Nogues |
| 5,751,661 | A | 5/1998 | Walters |

*Primary Examiner*—Bernard Roskoski
(74) *Attorney, Agent, or Firm*—Meroni & Meroni, P.C.; Charles F. Meroni, Jr.

(57) ABSTRACT

The bottle cap reminder device has a cap with an electronic counter means disposed within the cap. The electronic counter means progressively counts the time when activated and resets the time when deactivated. A power source preferably a battery provides the energy to run the electronic counter means. The power source is preferably housed within the electronic counter means and connected in circuit to the electronic counter means. A switching means is employed to activate and deactivate the electronic counter means. The switching means is comprised of a conductive contact lever connected in circuit to and extending from the electronic counter means, a conductive contact spring in conductive contact with the power source, and a conductive contact plate in conductive contact with the conductive contact spring.

40 Claims, 4 Drawing Sheets

BOTTLE CAP REMINDER DEVICE AND METHOD

This application is a Continuation-In-Part application of U.S. patent application Ser. No. 09/099,095 filed on Jun. 18, 1998.

BACKGROUND OF THE INVENTION

1. Field of the Invention

The present invention relates to prescription reminder devices. More specifically, the invention is primarily intended for use as a bottle or container cap reminder device that is attachable to a standard prescription bottle.

2. Description of the Prior Art

In the art of modem medicine the use of prescription drugs is very important in the treatment of ailments and illnesses. In order to remind patients of the need to regularly and consistently take prescription drugs, health care providers tell patients when to take prescribed dosages and pharmacists label the containers of prescription devices with the prescribed dosages and frequencies of taking the drugs.

For various reasons, many patients forget to take their prescription drugs and so the need for a prescription reminder device is needed and important for health and safety reasons. Accordingly, many devices exist for reminding patients to take their prescription drugs. For example, U.S. Pat. No. 4,528,933 shows a Container With Indicating Closure that uses a manually operable rotary reminder wheel to indicate days and hours so as to show when the next dosage is to be taken. U.S. Pat. No. 5,622,224 shows a Container With Time Indicator that is manually set by the user.

Furthermore, U.S. Pat. No. 4,768,176 shows an Apparatus For Alerting A Patient To Take Medication that utilizes an electrical signaling system. U.S. Pat. No. 4,939,705 discloses a Drug Dispensing Event Detector designed to show the time elapsed between opening and closing the cap so as to compare and show whether the cap was mishandled. In addition, U.S. Pat. No. 4,367,955 shows a Medicament Container With Timer Top that uses a mechanical clock means and U.S. Pat. No. 4,419,016 shows a Device For Indicating Last Medication Usage wherein the device shows the user the time at which he or she last took a previous dose of medication by showing the time and day of week when the cap was last opened. This device continues to display this information, even after reclosing the device.

U.S. Pat. No. 5,751,661 shows a Medication Dosage Timing Apparatus that with a timing apparatus that is activated and deactivated by moving a battery into and out of direct contact with the timing apparatus. The apparatus suffers in that the movement of the battery allows for the inadvertent contact between the timing apparatus and the battery by simply shaking the bottle. Consequently, a more reliable means of activating and deactivating a clock is needed.

What is needed is a means for reliably displaying the correct time elapsed since a prescription container or bottle has been opened, presumably, for taking a required dosage of prescription drugs, or medicine. The device must be simple in order to minimize the cost of manufacturing the device and capable of application to the varied standard prescription bottles and containers known in the art.

Accordingly, it is a principal object of my invention to provide a bottle cap reminder device that is compact and adaptable to any standard prescription bottle or container.

It is a further object of my invention to provide a bottle cap reminder device that correctly displays the time elapsed since a prescription bottle or container has been opened, which then resets itself upon reclosure of the device to the prescription bottle or container.

It is a further object of my invention to provide a bottle cap reminder device that is simple and economical to manufacture.

Other objects of my invention, as well as particular features, elements, and advantages thereof, will be elucidated in, or apparent from, the following description and the accompanying drawing figures.

SUMMARY OF THE INVENTION

Accordingly it is an object of this invention to provide a bottle cap reminder device that displays the time elapsed since a prescription bottle or container has been opened, which then resets itself upon reclosure of the device to the prescription bottle or container.

It is a further object of my invention to provide a bottle cap reminder device that is simple and economical to manufacture.

To achieve these objectives, and in accordance with the purposes of the present invention the following bottle cap reminder device is presented.

The bottle cap reminder device is comprised of a cap. The cap has a generally circular planar end with an aperture therethrough and a skirt extending circumferentially around the planar end, the skirt defining an open end. The skirt has an interior and an exterior surface. The interior surface has a plurality of engaging structures located near the open end to interlock with corresponding cap engagement lip structures located on a bottle.

An electronic counter means progressively counts the time when activated and resets the time when deactivated. The electronic counter means is disposed within the cap. The electronic counter means has a time counter display which displays the elapsed time. The time counter display is positioned coextensively with the aperture in the cap in order to allow the time counter display to be visible through the cap.

A power source preferably a battery provides the energy to run the electronic counter means. The power source is preferably housed within the electronic counter means and connected in circuit to the electronic counter means.

A switching means is employed to activate and deactivate the electronic counter means. The switching means completes a circuit between the power source and the electric counter means activating the electronic counter means when the cap is secured onto a bottle, and opening the circuit between the battery and the electronic counting means when the cap is not secured onto a bottle thereby deactivating the electronic counter means.

The switching means is comprised of a conductive contact lever connected in circuit to and extending from the electronic counter means, a conductive contact spring in conductive contact with the power source, and a conductive contact plate in conductive contact with the conductive contact spring.

The conductive contact lever is connected in circuit to the electronic counter means and extends from the electronic counter means in a circumferential and longitudinal direction towards the contact plate. The conductive contact spring has a first end and a second end. The first end is in conductive contact with the battery. The conductive contact spring is disposed within the cap to allow the spring to compress and decompress longitudinally within the cap. The conductive contact plate is disposed within the cap overlaying and in conductive contact with the second end of the conductive contact spring.

When the cap is secured onto a bottle, the contact plate moves longitudinally towards the contact lever compressing the contact spring and eventually contacting the conductive contact lever. Contact between the contact lever and the contact plate completes a conductive pathway between the power source and the electronic counter means activating the electronic counter means. When the cap is removed from a bottle, the contact spring decompresses moving the contact plate longitudinally away from the contact lever breaking contact between the contact plate and the contact lever. With no contact between the contact plate and the contact lever, no power is supplied to the electronic counter means and the electronic counter means is deactivated.

Other objects, features, and advantages of the invention will become more readily apparent upon reference to the following description when taken in conjunction with the accompanying drawings.

DETAILED DESCRIPTION OF THE PREFERRED EMBODIMENT

Figure 1:
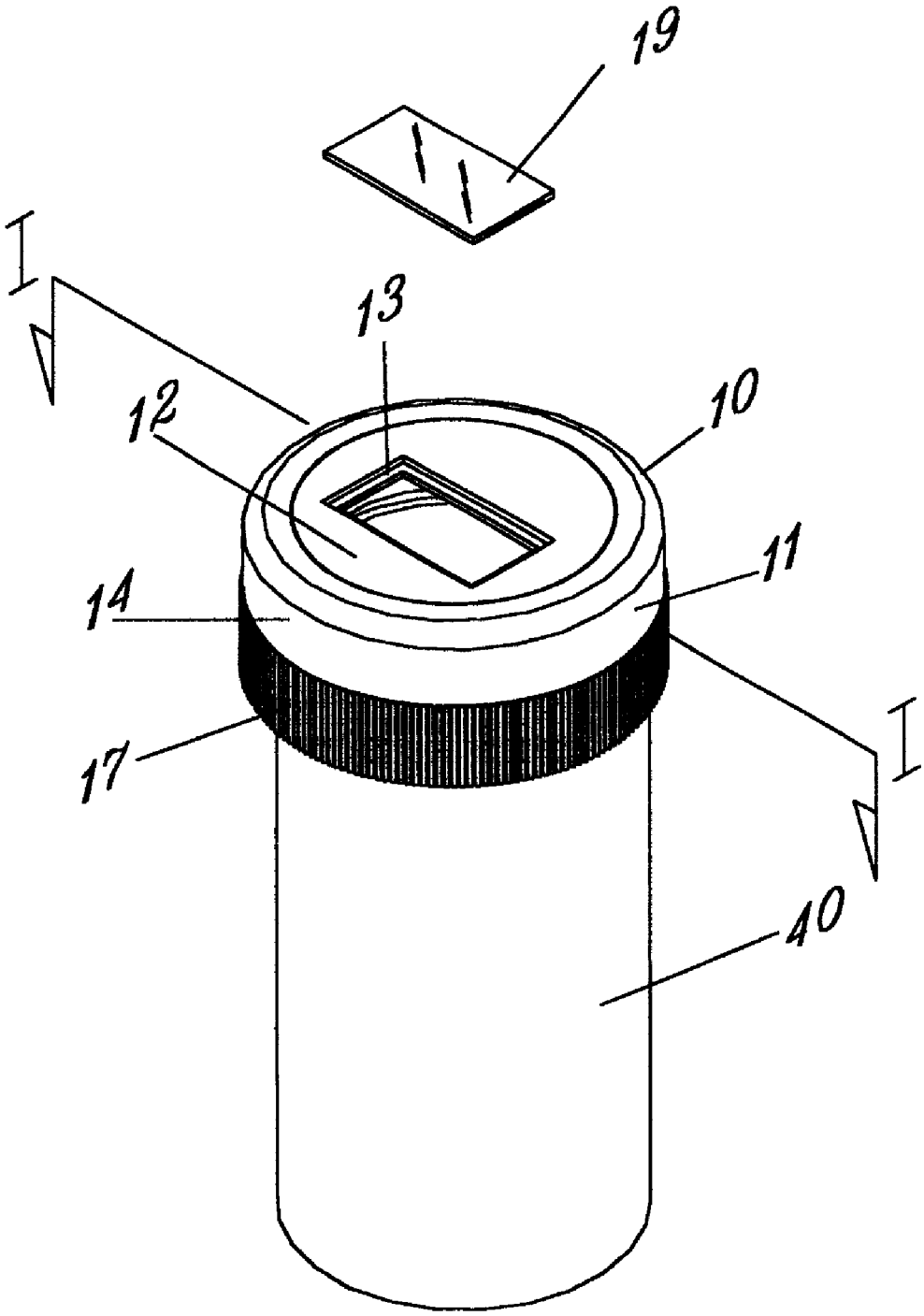
FIG. 1 is a perspective view of my invention, a bottle cap reminder device and a prescription bottle.

Referring to FIG. 1, the present invention is a bottle cap reminder device 10 preferably for use with a prescription bottle 40.

Figure 2:
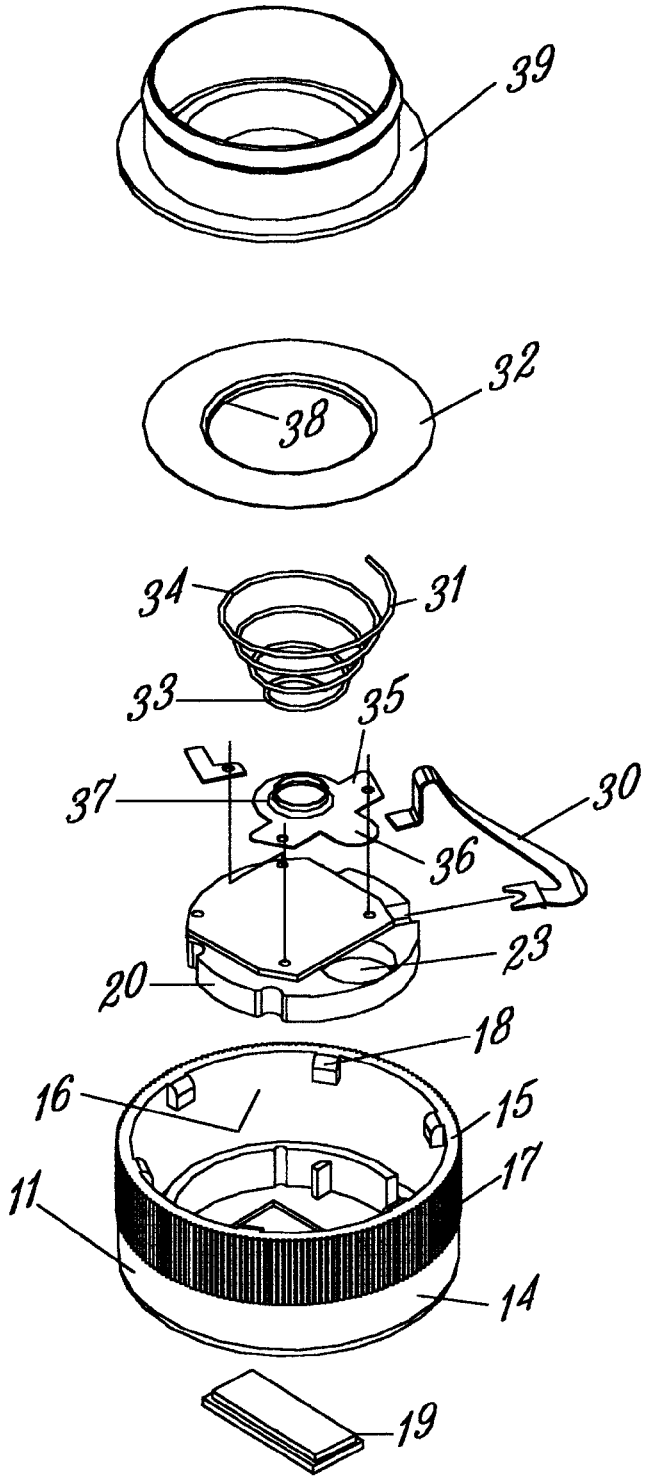
FIG. 2 is an exploded bottom view of my invention the bottle cap reminder device.
Figure 3:
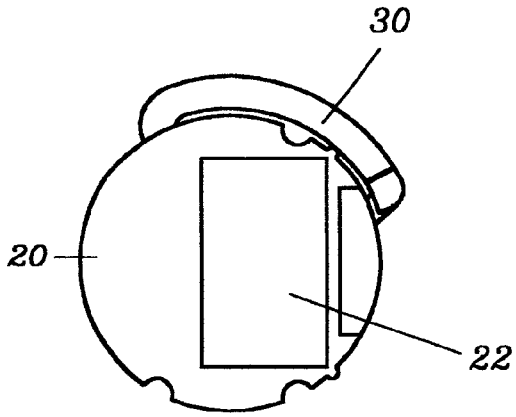
FIG. 3 is a top planar view of an electronic counter means found in my bottle cap reminder device revealing features.
Figure 4:
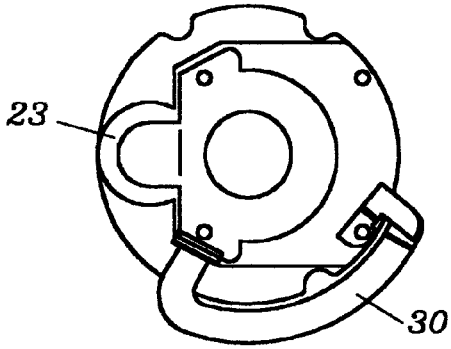
FIG. 4 is a bottom view of the electronic counter means in FIG. 4 revealing features.
Figure 5:
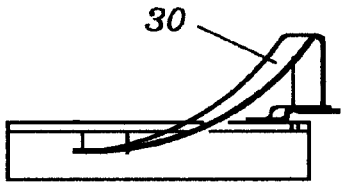
FIG. 5 is side view of the electronic counter means in FIG. 4 revealing features.

Referring to FIGS. 1 and 2, the bottle cap reminder device is comprised of a cap 11. The cap 11 has a generally circular planar end 12 with an aperture 13 therethrough and a skirt 14 extending circumferentially around the planar end 12, the skirt 14 defining an open end 15. The skirt 14 has an interior 16 and an exterior 17 surface. In the preferred embodiment, the interior surface 16 has a plurality of engaging structures 18 located near the open end 15 to interlock with corresponding cap engagement lip structures located on a child-proof prescription bottle. A lens 19 constructed of a clear polycarbonate material is attached to and spans across the aperture 13 in the cap.

Referring to FIGS. 2,3, 4 and 5, an electronic counter means 20 progressively counts the time when activated and resets the time when deactivated. The electronic counter means is disposed within the cap 14 and has a time counter display 22 which displays the elapsed time. The time counter display 22 is positioned coextensively with the aperture 13 in the cap 11 in order to allow the time counter display 22 to be visible through the cap 11. In the preferred embodiment of the invention, the time counter display 22 is a liquid crystal display and the electronic counter means 20 progressively counts time from 0 hours, 0 minutes to 23 hours 59 minutes. If the electronic means reaches 23 hours 59 minutes, the time flashes and remains on 23 hours 59 minutes until the electronic counter means is reset.

A power source provides the energy to run the electronic counter means 20 . In the preferred embodiment, the power source is a battery 23. However, other forms of power such as solar cells may also be used. The power source is preferably housed within the electronic counter means 20 and connected in circuit to the electronic counter means 22.

Referring to FIGS. 2, 6, 7, 8, a switching means is employed to activate and deactivate the electronic counter means 20. The switching means completes a circuit between the power source and the electric counter means 20 activating the electronic counter means 20 when the cap is secured onto a bottle 24, and opening the circuit between the battery 23 and the electronic counting means 20 when the cap 11 is not secured onto a bottle 24 thereby deactivating the electronic counter means 20. In the preferred embodiment, the switching means is comprised of a conductive contact lever 30 connected in circuit to and extending from the electronic counter means 20, a conductive contact spring 31 in conductive contact with the power source, and a conductive contact plate 32 in conductive contact with the conductive contact spring 31.

In the preferred embodiment, the conductive contact lever 30 is a thin conductive strip preferably made of bronze with a pre tinned or nickel finish. The conductive contact lever 30 is connected in circuit to the electronic counter means 20 and extends from the electronic counter means 20 in a circumferential and longitudinal direction towards the contact plate 32.

The conductive contact spring 31 is preferably made of bronze and has a first end 33 and a second end 34. In the preferred embodiment, the first end 33 is in conductive contact with the battery 23 through a conductive battery contact 35. The battery contact 35 has a contact tongue 36 in conductive contact with the battery 23 and a first spring retaining lip 37. The spring retaining lip 37 is disposed within the first end 33 of the conductive contact spring securing the first end 33 of the conductive contact spring 31 to the conductive battery contact 35. The conductive contact spring 31 is disposed within the cap 11 to allow the spring to compress and decompress longitudinally within the cap 11.

The conductive contact plate 32 is disposed within the cap 11 overlaying and in conductive contact with the second end 34 of the conductive contact spring 31. The conductive contact plate 32 is preferably made of brass with a pre tinned or nickel finish. A second spring retaining lip 38 extends from the conductive contact plate 32. The second spring retaining lip 38 is disposed within the second end 34 of the conductive contact spring 31, securing the second end 34 of the conductive contact spring 31 to the conductive contact plate 32.

In the preferred embodiment, a bottle sealing means 39 is also disposed within the cap 11 overlaying the contact plate 32 and capable of longitudinal movement within the cap 11. A retaining means on the interior surface of the skirt 14 retains the bottle sealing means 39 within the cap 11.

Figures 6, 7, 8:
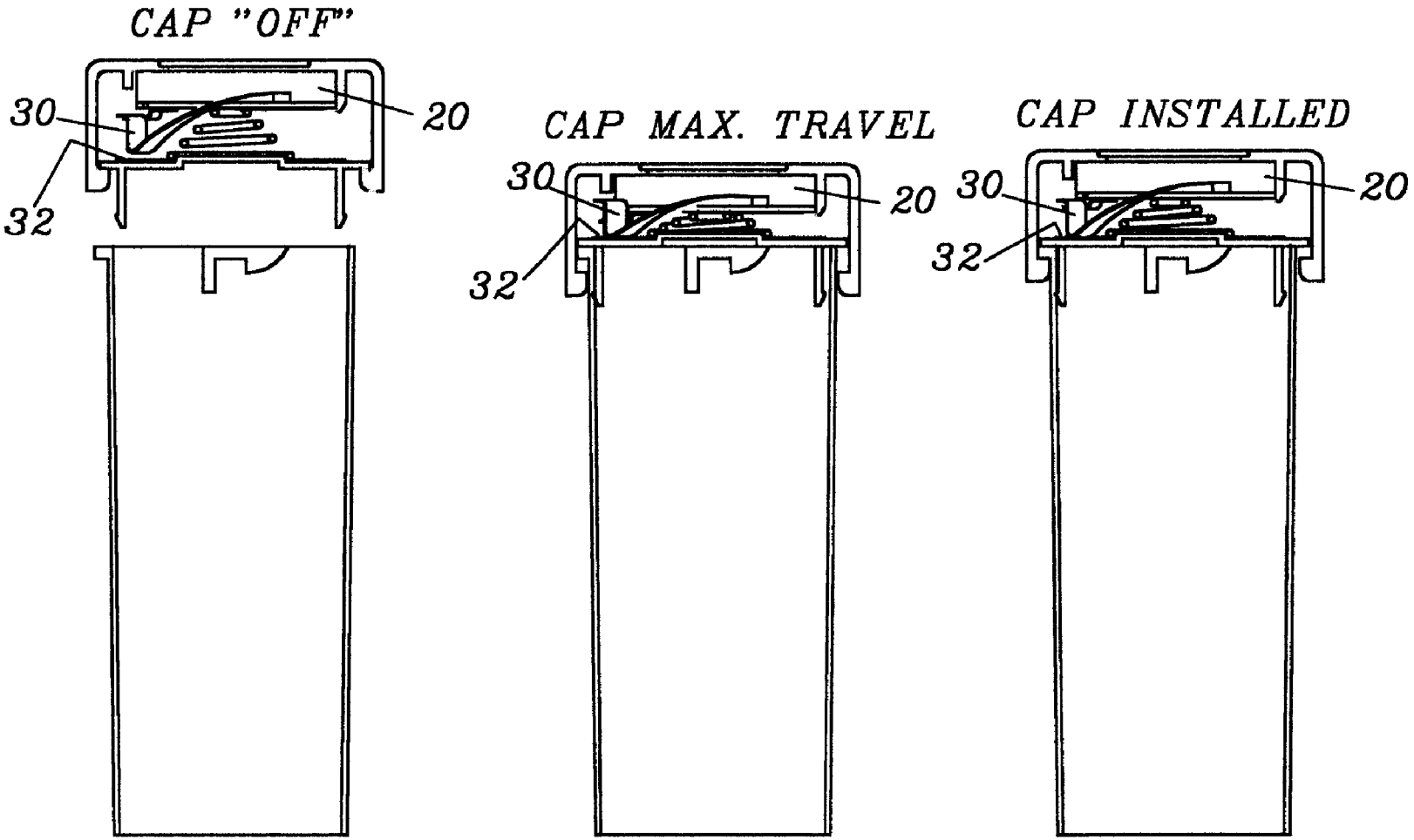
FIG. 6 is a side sectional view taken along lines I—I of the bottle cap reminder device in FIG. 1 with the cap removed.
FIG. 7 is a side sectional view taken along lines I—I of the bottle cap reminder device in FIG. 1 with the cap filly pressed down.
FIG. 8 is a side sectional view taken along lines I—I of the bottle cap reminder device in FIG. 1 with the cap secured onto the bottle.

Referring to FIGS. 6, 7, and 8, in the preferred embodiment, when the cap 11 is secured onto a bottle, the opening of the bottle pushes on the bottle sealing means 39 and the conductive contact plate 32. The conductive contact plate 32 moves longitudinally towards the contact lever 30 compressing the contact spring 31 and eventually contacting the conductive contact lever 30. Contact between the contact lever 30 and the contact plate 32 completes a conductive pathway between the battery 23 and the electronic counter means 20 activating the electronic counter means 20. When the cap 11 is removed from a bottle, the contact spring 31 decompresses moving the contact plate 32 longitudinally away from the contact lever 30 breaking contact between the contact plate 32 and the contact lever 30. With no contact between the contact plate 32 and the contact lever 30, no power is supplied to the electronic counter means 20 and the electronic counter means 20 is deactivated.

In the preferred method of using the present invention, the bottle cap reminder device 10 is secured onto a prescription bottle activating the electronic counter means 20 causing the electronic counting means 20 to progressively count the time. The visual display 22 on the bottle cap reminder device is then periodically monitored in order to determine if there has been a sufficient amount of time elapsed to take a dosage of medication. Once a sufficient amount of time has elapsed, the bottle cap reminder device 10 is removed from the bottle, the removal of the bottle cap reminder device 10 resetting the electronic counter means 20. A dosage of medication is then removed from the prescription bottle and the bottle cap reminder device 10 is resecured onto the prescription bottle causing the electronic counter means to progressively count the time.

The foregoing descriptions of the preferred embodiments of the invention have been presented for purposes of illustration and description, and are not intended to be exhaustive or to limit the invention to the precise forms disclosed. The descriptions were selected to best explain the principles of the invention and their practical application to enable others skilled in the art to best utilize the invention in various embodiments and various modifications as are suited to be particular use contemplated. It is not intended that the novel device be limited thereby. The preferred embodiment may be susceptible to modifications and variations that are within the scope and fair meaning of the accompanying claims and drawings.

I claim:

1. A medicine prescription bottle cap reminder device for use with a prescription bottle, the medicine prescription bottle cap reminder device comprising:

a cap, the cap having a generally circular planar end with an aperture therethrough and a skirt extending circumferentially around the generally circular planar end, the skirt having an interior and an exterior surface;

an electronic counter means, the electronic counter means disposed within the cap and having a time counter display, the time counter display positioned coextensively with the aperture in the cap, the electronic counter means progressively counting the time when activated and resetting the time when deactivated;

a conductive contact lever, the conductive contact lever connected in circuit to and extending from the electronic counter means;

a battery, the battery housed within the electronic counter means;

a conductive contact spring, the conductive contact spring having a first end and a second end, the first end in conductive contact with the battery, the conductive contact spring disposed within the cap to allow the spring to compress and decompress longitudinally within the cap; and a conductive contact plate, the conductive contact plate disposed within the cap overlaying and in conductive contact with the second end of the conductive contact spring, the conductive contact plate moving longitudinally towards the contact lever and contacting the conductive contact lever when the cap is secured onto a bottle and moving longitudinally away from the contact lever breaking contact with the contact lever when the cap is not secured onto a bottle, contact between the contact lever and the contact plate completing a conductive pathway between the battery and the electronic counter means activating the electronic counter means, the electronic counter means deactivating when the contact plate and the contact lever are not in contact.

2. The medicine prescription bottle cap reminder device of claim 1 further comprising a conductive battery contact, the battery contact having a contact tongue in conductive contact with the battery and a spring retaining lip, the spring retaining lip disposed within the first end of the conductive contact spring.

3. The medicine prescription bottle cap reminder device of claim 1, further comprising a bottle sealing means disposed within the cap overlaying the contact plate and capable of longitudinal movement within the cap, the cap having a retaining means on the interior surface of the skirt for retaining the bottle sealing means within the cap.

4. The medicine prescription bottle cap reminder device of claim 1, wherein the time-counter display is a liquid crystal display, a lens being constructed of a clear polycarbonate material being attached to and spanning across the aperture in the cap.

5. The medicine prescription bottle cap reminder device of claim 1, wherein the conductive contact lever is a thin conductive strip extending from the electronic counter means in a circumferential and longitudinal direction towards the contact plate.

6. The medicine prescription bottle cap reminder device of claim 1 wherein the electronic counter means progressively counts time from 0 hours, 0 minutes to 23 hours 59 minutes, the time flashing and remaining on 23 hours 59 minutes until the electronic counter means is reset.

7. A bottle cap reminder device, the bottle cap reminder device comprising:

a cap, the cap having a generally circular planar end with an aperture therethrough and a skirt extending circumferentially around the generally circular planar end, the skirt having an interior and an exterior surface;

an electronic counter means, the electronic counter means disposed within the cap and having a time counter display, the time counter display positioned coextensively with the aperture in the cap, the electronic counter means progressively counting the time when activated and resetting the time when deactivated;

a power source, the power source connected in a stationary manner to the electronic counter means; and switching means, the switching means disposed within the cap and completing a circuit between the power source and the electric counter means activating the electronic counter means when the cap is secured onto a bottle, and opening the circuit between the power source and the electronic counting means when the cap is not secured onto a bottle, deactivating the electronic counter means.

8. The bottle cap reminder device in claim 7 further comprising a conductive contact lever connected in circuit to and extending from the electronic counter means, the conductive contact plate moving longitudinally toward the contact lever and contacting the contact lever completing a conductive pathway between the power source and the electronic counter means activating the electronic counter means when the cap is secured onto a bottle and moving longitudinally away from the contact lever breaking contact with the contact lever when the cap is not secured onto a bottle.

9. The bottle cap reminder device of claim 8, wherein the conductive contact lever is a thin conductive strip extending from the electronic counter means in a circumferential and longitudinal direction towards the contact plate.

10. The bottle cap reminder device of claim 9, wherein the power source is a battery.

11. The bottle cap reminder device of claim 10 further comprising a conductive battery contact, the battery contact having a contact tongue in conductive contact with the battery and a spring retaining lip, the spring retaining lip disposed within the first end of the conductive contact spring.

12. The bottle cap reminder device of claim 11, further comprising a bottle sealing means disposed within the cap overlaying the contact plate and capable of longitudinal movement within the cap, the cap having a retaining means on the interior surface of the skirt for retaining the bottle sealing means within the cap.

13. The bottle cap reminder device of claim 12, wherein the time-counter display is a liquid crystal display, a lens being constructed of a clear polycarbonate material being attached to and spanning across the aperture in the cap.

14. The bottle cap reminder device of claim 13 wherein the electronic counter means progressively counts time from 1 second to 23 hours 59 minutes.

15. A prescription drug container with a reminder device, the prescription container comprising:

a bottle, the bottle having cap engagement lip structures;

a cap, the cap having a generally circular planar end with an aperture therethrough and a skirt extending circumferentially around the generally circular planar end, the skirt having an interior and an exterior surface, the interior surface having a plurality of corresponding engaging structures to interlock with the cap engagement lip structures on the bottle;

an electronic counter means, the electronic counter means disposed within the cap and having a time counter display, the time counter display positioned coextensively with the aperture in the cap, the electronic counter means progressively counting the time when activated and resetting the time when deactivated; and a switching means disposed within the cap, the switching means including a conductive contact spring closing the switching means activating the electronic counter means when the cap is secured onto a bottle and opening the switching means deactivating the electronic counter means when the cap is unsecured from a bottle and a conductive contact plate disposed within the cap overlaying and in conductive contact with the conductive contact spring.

16. The prescription drug container in claim 15 further comprising a power source and wherein the switching means is comprised of a conductive contact lever connected in circuit to and extending from the electronic counter means, the contact plate moving longitudinally toward the contact lever and contacting the contact lever completing a conductive pathway between the power source and the electronic counter means activating the electronic counter means when the cap is secured onto a bottle and moving longitudinally away from the contact lever breaking contact with the contact lever when the cap is not secured onto a bottle.

17. The prescription drug container of claim 16, further comprising a bottle sealing means disposed within the cap overlaying the contact plate and capable of longitudinal movement within the cap, the cap having a retaining means on the interior surface of the skirt for retaining the bottle sealing means within the cap.

18. The prescription drug container of claim 17 wherein the power source is a battery and further comprising a conductive battery contact, the battery contact having a contact tongue in conductive contact with the battery and a spring retaining lip, the spring retaining lip disposed within the first end of the conductive contact spring.

19. The prescription drug container of claim 18, wherein the conductive contact lever is a thin conductive strip extending from the electronic counter means in a circumferential and longitudinal direction towards the contact plate.

20. The prescription drug container of claim 19, wherein the time-counter display is a liquid crystal display, a lens being constructed of a clear polycarbonate material being attached to and spanning across the aperture in the cap.

21. The prescription drug container of claim 20 wherein the electronic counter means progressively counts and displays time from 0 hours, 0 minutes, the time counter display remaining at 23 hours 59 minutes until the cap is removed and the electronic counting means is reset.

22. The prescription drug container of claim 16 wherein the power source is a battery and further comprising a conductive battery contact, the battery contact having a contact tongue in conductive contact with the battery and a spring retaining lip, the spring retaining lip disposed within the first end of the conductive contact spring.

23. The prescription drug container of claim 16, wherein the conductive contact lever is a thin conductive strip extending from the electronic counter means in a circumferential and longitudinal direction towards the contact plate.

24. The prescription drug container of claim 16, wherein the time-counter display is a liquid crystal display, a lens being constructed of a clear polycarbonate material being attached to and spanning across the aperture in the cap.

25. The prescription drug container of claim 16 wherein the electronic counter means progressively counts and displays time from 0 hours, 0 minutes, the time counter display remaining at 23 hours 59 minutes until the cap is removed and the electronic counting means is reset.

26. A method of using a bottle cap reminder device with a prescription bottle, the method comprising the steps of:

securing a bottle cap reminder device onto a prescription bottle, the bottle cap reminder device comprising a cap, an electronic counter means with a time display disposed within the cap, the time counter display positioned coextensively with an aperture in the cap, the electronic counter means progressively counting the time when the cap is secured onto the prescription bottle, the electronic counter means having switching means activating the time counting means when the bottle cap is secured to the prescription medicine bottle, said switching means deactivating and resetting the time counting means when the bottle cap is not secured to the prescription medicine bottle, the switching means comprising an electrically conductive contact lever which extends from the electronic time counting means, and an electrically conductive contact plate which extends from the power source, the contact lever is not electrically connected to said contact plate when said bottle cap is not secured to said prescription medicine bottle resulting in deactivation of the electronic time counting means, the contact lever electrically connected to said contact plate when said bottle cap is secured to said prescription medicine bottle resulting in a closed circuit and activation of said electronic time counting means;

waiting until a sufficient amount of time has elapsed until another dosage of medication is to be taken;

periodically monitoring the visual display on the bottle cap reminder device in order to determine if there has been a sufficient amount of time elapsed to take a dosage of medication;

removing the bottle cap reminder device when a sufficient time has elapsed for a dosage of medication, the removal of the cap resetting the electronic counter means;

removing the dosage of medication from the prescription bottle; and resecuring the bottle cap reminder device onto the prescription bottle causing the electronic counter means to progressively count the time.

27. A bottle cap reminder device, the bottle cap reminder device comprising:

a cap, the cap having a generally circular planar end with an aperture therethrough and a skirt extending circumferentially around the generally circular planar end, the skirt having an interior and an exterior surface;

an electronic counter means, the electronic counter means disposed within the cap and having a time counter display, the time counter display positioned coextensively with the aperture in the cap, the electronic counter means progressively counting the time when activated and resetting the time when deactivated;

a power source, the power source connected in a stationary manner to the electronic counter means; and switching means, the switching means disposed within the cap and completing a circuit between the power source and the electric counter means activating the electronic counter means when the cap is secured onto a bottle, and opening the circuit between the power source and the electronic counting means when the cap is not secured onto a bottle, deactivating the electronic counter means, wherein the switching means is comprised of a conductive contact lever, the conductive contact lever connected in circuit to and extending from the electronic counter means, a conductive contact spring with a first end and a second end, the first end in conductive contact with the power source, the conductive contact spring disposed within the cap to allow the conductive contact spring to compress and decompress longitudinally within the cap, and a conductive contact plate, the conductive contact plate disposed within the cap overlaying and in conductive contact with the second end of the conductive contact spring, the conductive contact plate moving longitudinally towards the contact lever and contacting the conductive contact lever when the cap is secured onto a bottle and moving longitudinally away from the contact lever breaking contact with the contact lever when the cap is not secured onto a bottle, contact between the contact lever and the contact plate completing a conductive pathway between the power source and the electronic counter means activating the electronic counter means, the electronic counter means deactivating when the contact plate and the contact lever are not in contact.

28. The bottle cap reminder device of claim 27, wherein the conductive contact lever is a thin conductive strip extending from the electronic counter means in a circumferential and longitudinal direction towards the contact plate.

29. The bottle cap reminder device of claim 28, wherein the power source is a battery.

30. The bottle cap reminder device of claim 29, further comprising a conductive battery contact, the battery contact having a contact tongue in conductive contact with the battery and a spring retaining lip, the spring retaining lip disposed within the first end of the conductive contact spring.

31. The bottle cap reminder device of claim 30, further comprising a bottle sealing means disposed within the cap overlaying the contact plate and capable of longitudinal movement within the cap, the cap having a retaining means on the interior surface of the skirt for retaining the bottle sealing means within the cap.

32. The bottle cap reminder device of claim 31, wherein the time-counter display is a liquid crystal display, a lens being constructed of a clear polycarbonate material being attached to and spanning across the aperture in the cap.

33. The bottle cap reminder device of claim 30 wherein the electronic counter means progressively counts time from 0 hours and 0 minutes to 23 hours and 59 minutes.

34. A prescription drug container with a reminder device, the prescription container comprising.

a bottle, the bottle having cap engagement lip structures;

a cap, the cap having a generally circular planar end with an aperture therethrough and a skirt extending circumferentially around the generally circular planar end, the skirt having an interior and an exterior surface, the interior surface having a plurality of corresponding engaging structures to interlock with the cap engagement lip structures on the bottle; and an electronic counter means, the electronic counter means disposed within the cap and having a time counter display, the time counter display positioned coextensively with the aperture in the cap, the electronic counter means progressively counting the time when activated and resetting the time when deactivated;

a switching means disposed within the cap, the switching means closing, activating the electronic counter means, when the cap is secured onto a bottle, and opening, deactivating the electronic counter means, when the cap is not secured, and a power source, wherein the switching means is comprised of a conductive contact lever, the conductive contact lever connected in circuit to and extending from the electronic counter means, a conductive contact spring with a first end and a second end, the first end in conductive contact with the power source, the conductive contact spring disposed within the cap to allow the conductive contact spring to compress and decompress longitudinally within the cap, and a conductive contact plate, the conductive contact plate disposed within the cap overlaying and in conductive contact with the second end of the conductive contact spring, the conductive contact plate moving longitudinally towards the contact lever and contacting the conductive contact lever when the cap is secured onto a bottle and moving longitudinally away from the contact lever breaking contact with the contact lever when the cap is not secured onto a bottle, contact between the contact lever and the contact plate completing a conductive pathway between the power source and the electronic counter means activating the electronic counter means, the electronic counter means deactivating when the contact plate and the contact lever are not in contact.

35. The prescription drug container of claim 34, further comprising a bottle sealing means disposed within the cap overlaying the contact plate and capable of longitudinal movement within the cap, the cap having a retaining means on the interior surface of the skirt for retaining the bottle sealing means within the cap.

36. The prescription drug container of claim 31 wherein the power source is a battery and further comprising a conductive battery contact, the battery contact having a contact tongue in conductive contact with the battery and a spring retaining lip, the spring retaining lip disposed within the first end of the conductive contact spring.

37. The prescription drug container of claim 36, wherein the conductive contact lever is a thin conductive strip extending from the electronic counter means in a circumferential and longitudinal direction towards the contact plate.

38. The prescription drug container of claim 37, wherein the time-counter display is a liquid crystal display, a lens being constructed of a clear polycarbonate material being attached to and spanning across the aperture in the cap.

39. The prescription drug container of claim 38 wherein the electronic counter means progressively counts and displays time from 0 hours, 0 minutes, the time counter display remaining at 23 hours 59 minutes until the cap is removed and the electronic counting means is reset.

40. A bottle cap time counting device for use with prescription medicine bottles, the bottle cap time counting device comprising a bottle cap with bottle sealing means, an electronic time counting device housed within said bottle cap and comprising an elapsed time display, said elapsed time display located on an upper surface of said bottle cap, a power source which is disposed within said bottle cap and which provides power for the electronic time counting device, and longitudinally extending switching means for activating, and for deactivating and resetting to zero the electronic time counting device wherein said switching means comprises a conductive contact lever, a conductive contact spring, and a conductive plate, the conductive contact lever extending from said electronic time counting device, the conductive contact lever oriented generally longitudinally within said bottle cap, and spaced apart from said conductive plate when the bottle cap is not secured to a prescription medicine bottle, the conductive contact spring is in conductive contact with said power source, the conductive plate lies within an upper portion of said bottle cap, and is longitudinally movable within said bottle cap when the bottle cap is secure to a prescription medicine bottle, said longitudinal motion of said conductive plate first compressing said conductive contact spring and then making conductive contact with said conductive contact lever, this conductive contact between said conductive contact lever, said conductive contact spring, and said conductive plate forming a closed circuit and activating said bottle cap counting device.

* * * * *